United States Patent [19]

Kohl

[11] 4,444,145

[45] Apr. 24, 1984

[54] STEERING APPARATUS FOR BOATS WITH MULTIPLE RUDDERS

[76] Inventor: Douglas A. Kohl, 417 - 6th Ave. NE., Osseo, Minn. 55369

[21] Appl. No.: 329,803

[22] Filed: Dec. 11, 1981

[51] Int. Cl.[3] ..... B63H 25/06

[52] U.S. Cl. ..... 114/163; 114/144 R; 114/150

[58] Field of Search ..... 114/162, 163, 144 R, 114/150

[56] References Cited

FOREIGN PATENT DOCUMENTS 822353 11/1951 Fed. Rep. of Germany ..... 114/163

*Primary Examiner*—Sherman D. Basinger

*Attorney, Agent, or Firm*—Peterson, Palmatier, Sturm, Sjoquist & Baker, Ltd.

[57] ABSTRACT

Steering apparatus for a boat includes a pair of laterally spaced rudders, each having a forwardly directed control arm. In each of three embodiments a tiller arm is employed. In one embodiment a pinion gear is journaled for rotation on the tiller arm, being in mesh with two gear racks each of which connects with a control arm. In a second embodiment, the tiller arm shifts a pair of pulleys about which is entrained a rope or cable, one control arm being clamped to a cable section at one side of the pulleys and the other control arm being clamped to the cable section of the other side of the pulleys. In the third embodiment, a pair of hydraulic cylinders have their closed ends pivotally connected to the tiller arm and their piston rods connected to the control arms. The open end of one cylinder is hydraulically coupled to the closed end of the other cylinder, and the closed end of said one cylinder is hydraulically coupled to the open end of said other cylinder.

10 Claims, 7 Drawing Figures

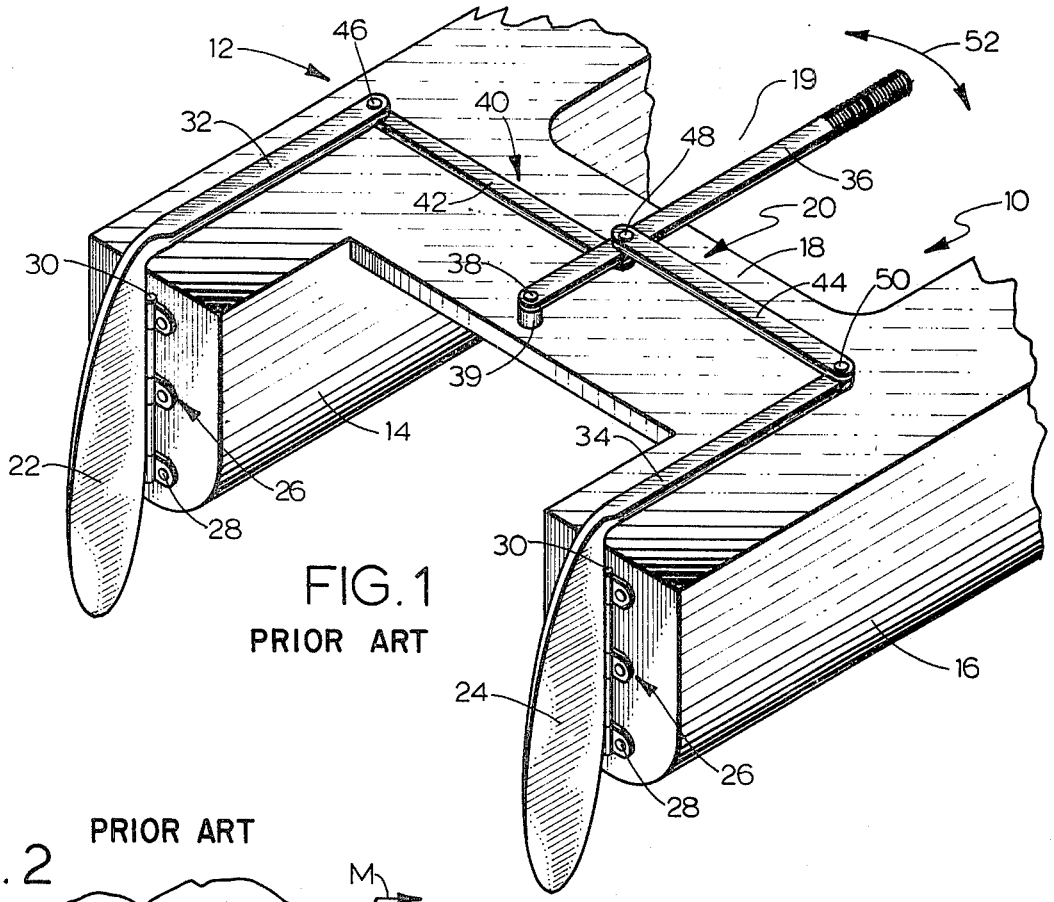
FIG. 1
PRIOR ART
FIG. 2
PRIOR ART
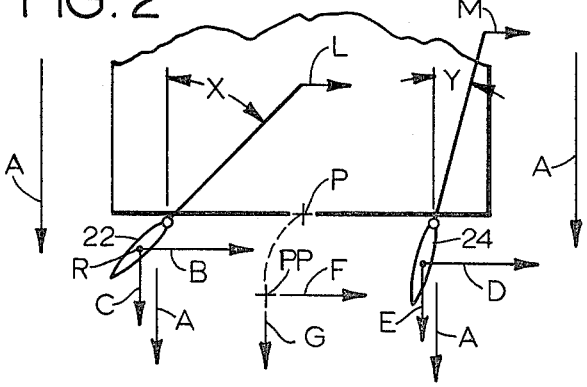
FIG. 4
PRIOR ART
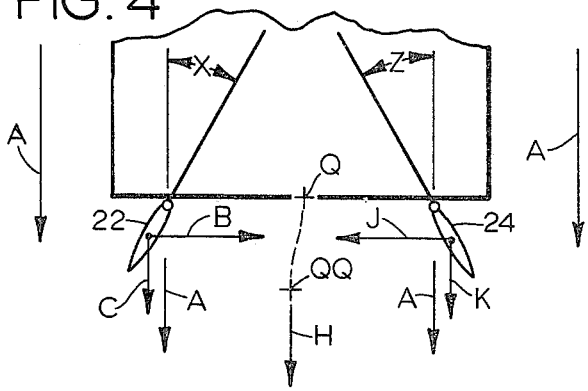
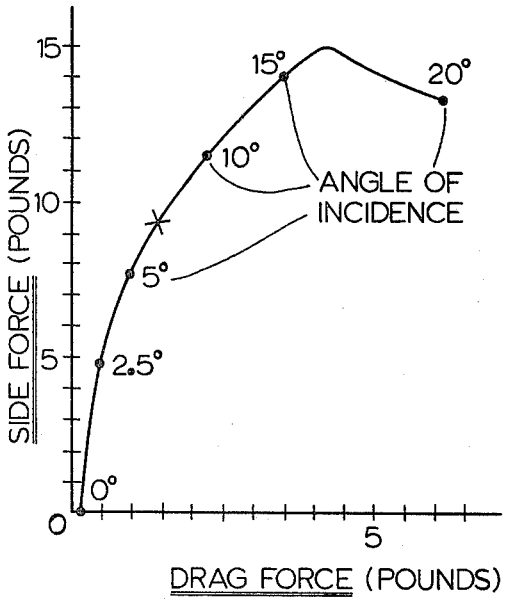
FIG. 3

STEERING APPARATUS FOR BOATS WITH MULTIPLE RUDDERS

BACKGROUND OF THE INVENTION

This invention relates generally to boats with two or more rudders, and pertains more particularly to apparatus for minimizing the drag produced by the rudders due to unequal hydrodynamic forces and toe-in or toe-out alignments.

DESCRIPTION OF THE PRIOR ART

Twin rudder boats have been employed for various reasons. While unnecessary drag is always a factor to contend with irrespective of the particular type of boat having multiple rudders, any excessive rudder drag becomes extremely important with respect to sailboats utilizing twin rudders, such as those employed on catamaran boats.

Owing to the lateral spacing of the rudders when more than one rudder is present, one rudder can be subjected to different and continually varying hydrodynamic forces from those forces acting on the other rudder (or rudders) as the boat moves through the water. The drag resulting from the unequal forces and toe-in or toe-out alignment becomes particularly significant when a twin rudder sailboat is competing in a race.

Various attempts have been made in the past to angularly adjust twin rudders to cope with certain situations. For the most part, those which which I am acquainted have produced either fixed or prescribed angular differences between the rudders. In this regard, attention is directed to U.S. Pat. No. 3,147,730, granted on Sept. 8, 1974 to Franz R. Specht, for "Differential Rudder Control System". In this instance, the control system is utilized with a power boat having twin screws and twin rudders, the aim of the patented invention being to maintain the outboard rudder in substantial alignment with the propeller wash while turns are being effected with the inboard rudder. No effort is made to equalize the forces on the two rudders, however.

In U.S. Pat. No. 3,190,251, issued June 22, 1965 to August W. Kumpf for "Vessel Having Twin Rudders with Controlled Toe-Out", predetermined angular differences between the two rudders are automatically achieved, the angular movement imparted to the rudders being either added or subtracted, as the case may be, for the purpose of producing directional stability in ships with long hulls, when needed during maneuvers in close quarters. The invention is described in conjunction with large powered seagoing vessels.

U.S. Pat. No. 3,106,178, granted on Oct. 8, 1963, to Richard C. Cale involves a "Trim Control Device" that is also intended for power boats. In this instance, there is imposed an equal angular change for each of the two rudders in an opposite angular direction from each other. The trim control results in increased rudder drag.

SUMMARY OF THE INVENTION

An important object of my invention is to provide apparatus for steering a boat having multiple rudders thereon, the invention enabling the boat to be moved with a minimum of hydrodynamic drag on the rudders caused from changing stream-flow conditions of the water as the vessel moves therethrough. More specifically, an aim of the invention is to change the angles of the rudders in a variable relationship with each other so that an equalization of side forces on the two or more rudders automatically is realized. It should be evident that any undue drag forces will slow the boat down whether the boat is wind-driven or motor-driven.

Another object is to provide a steering apparatus which automatically positions the rudders at their proper angles during turns when rudder angles are based on tangents to turning arcs of differing radii.

Another object is to provide steering apparatus of the foregoing character in which the steering is achieved in a conventional manner, the operator not having to concern himself with the force equalization which occurs automatically when utilizing the teaching of my invention.

Another object of the invention is to provide steering apparatus for boats, particularly twin hull boats having a rudder for each hull, that is simple and inexpensive to manufacture, and which can be adapted readily to boats already in existence.

Yet another object is to provide steering apparatus that is exceedingly rugged, requiring little or no attention from the boat's operator.

Briefly, my invention envisages the provision of steering apparatus for use on boats having two or more laterally spaced rudders, each rudder having a forwardly extending control arm integral therewith. The forward end portions of the control arms are interconnected with each other through the agency of a mechanism that will automatically transfer or transmit force from one rudder to the other and vice versa, yet enabling the operator to steer the boat in the usual manner without regard to the equalization of forces that occurs during whatever angular positions the rudders are in for turning the boat in the desired direction. In one embodiment, the force equalization is realized with differential gearing; in another embodiment, the equalization is achieved with a pulley and cable arrangement, and in a third embodiment, the equalization is accomplished hydraulically.

BRIEF DESCRIPTION OF THE DRAWINGS

FIG. 1 is a perspective view of the stern portion of a twin hull boat having a pair of rudders mounted thereon, the view depicting a conventional connection of the rudders with each other resulting in the rudders being pivoted in unison;

FIG. 2 is a plan view corresponding to FIG. 1, the view being even more diagrammatic than FIG. 1, and having superimposed thereon certain vectors for the purpose of illustrating the drag resulting from improper rudder angles;

FIG. 3 is a graphical representation with typical side forces being plotted against typical drag forces in order to provide a visual understanding of the shortcomings of conventional steering arrangements;

FIG. 4 is another diagrammatic view which is similar to FIG. 2 but depicting a prior art situation in which the rudders are toed in;

EXEMPLARY PRIOR ART STEERING APPARATUS

Figure 5:
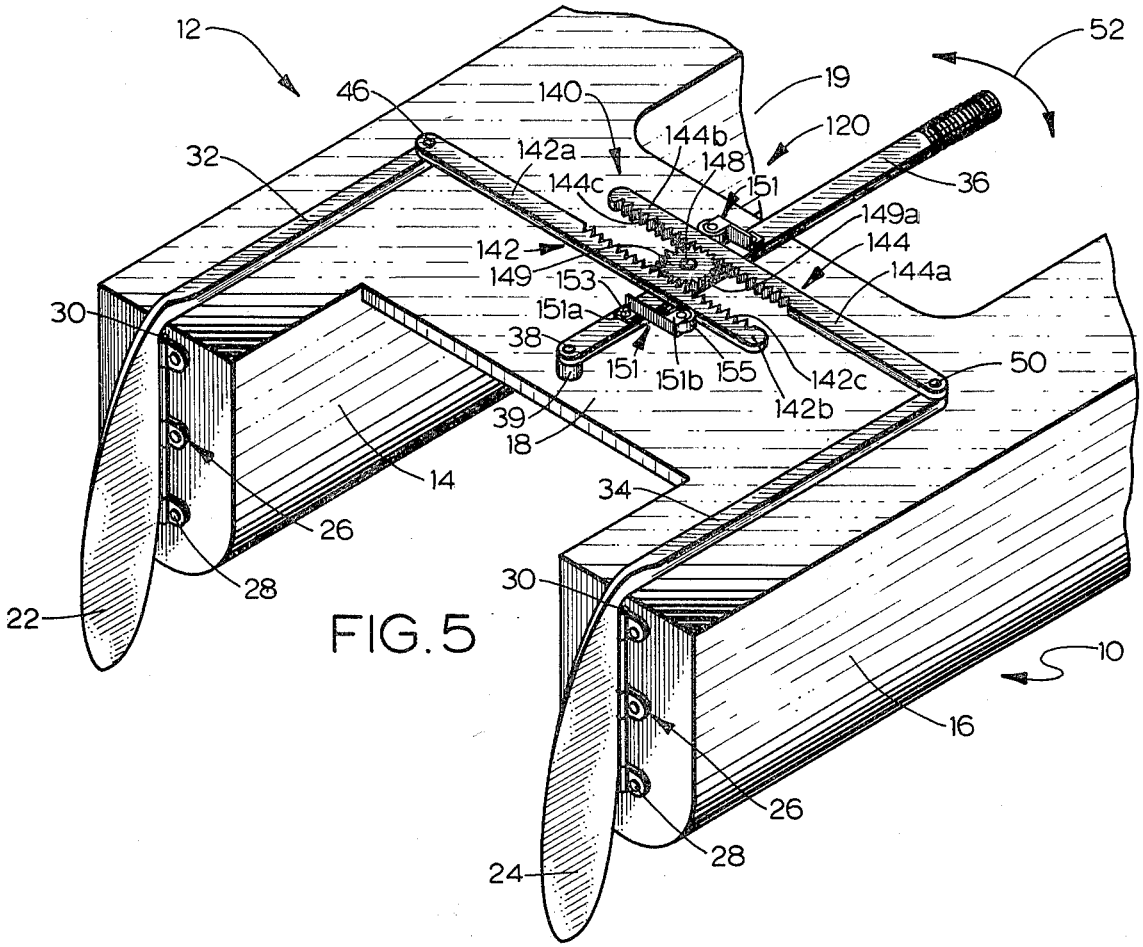
FIG. 5 is a top plan view corresponding to FIGS. 2 and 4 but incorporating one embodiment of my invention therein.

Referring to FIG. 1, the stern portion of a boat 10 has been labeled 12, the stern portion 12 including twin hulls 14 and 16 connected by a deck section or platform 18. As is typical with twin hulled sailboats, there is an open space, such as that indicated by the reference numeral 19, which resides in between the two hulls 14, 16. Although not shown, there would be another deck section or some form of crossbeam forwardly that would support a mast and sail configuration when the craft 10 is a sailboat and designed to be propelled by wind action. It should be explained at the outset that my invention finds the greatest utility with respect to twin-hulled sailboats such as those of the catamaran variety, because drag forces can become exceedingly important, particularly when the boat is participating in competitive activities with other sailboats.

Typical steering apparatus has been indicated generally by the reference numeral 10 in FIG. 1. Although the specific manner in which the two rudders indicated by the reference numerals 22 and 24 are pivotally mounted to the rear ends of the hulls 14 and 16 is not important to an understanding of the invention, nonetheless, it will be seen from FIG. 1 that each rudder 22, 24 is pivotally mounted about a generally vertical axis by reason of hinges 26 and 28. The hinges 26, 28 are composed of interleaved knuckles with certain of the knuckles being attached to the rear ends of the hulls by screws 28. A pin 30 extends downwardly through the knuckles of each hinge 26 to provide the requisite pivotal mounting for the rudders 22, 24.

Included in the steering apparatus 20 and extending forwardly from the port rudder 22 is a control arm 32 and extending forwardly from the starboard rudder 24 is a duplicate arm 34. It is important to appreciate that each control arm 32, 34 is rigidly secured to the particular rudder with which it is associated.

A tiller arm 36 is pivotally attached to the deck section 18 by means of a pin 38, the pin 38 extending downwardly through a vertical spaced block 39 disposed between the pivoted end of the arm 36 and the surface of the deck section. Tie rod means 40 comprised of two tie rod portions 42 and 44 are utilized so as to transmit steering forces from the tiller arm 36 to the control arms 32, 34. More specifically, the tie rod portion 42 is pivotally attached at one end to the forward end of the control arm 32 associated with the port rudder 22 by a pin 46, the other end of the tie rod portion 42 being pivotally attached to the tiller arm 36 by means of an additional pin 48. Another pin 50 is utilized to pivotally connect one end of the second tie rod portion 44 to the forward end of the control arm 34 for the starboard rudder 24. The other end of tie rod portion 44 is connected to the tiller arm 36 by the previously mentioned pin 48.

A double-headed arrow 52 indicates the direction in which the tiller arm 36 is manually actuated. Manual movement of the tiller arm 36 causes this arm to pivot about its pin 38 with the consequence that forces are simultaneously transmitted via the tie rod portions 42, 44 to the control arms 32, 34 and hence to the two rudders 22, 24 in order to angularly adjust them in accordance with the position to which the tiller arm 36 has been shifted and the direction the boat 10 is to turn.

Referring to FIG. 2, the generation of the hydrodynamic forces on the rudders 22, 24 will now be described. It will be understood that as the boat 10 moves forwardly, there is relative movement of the water beneath the stern 12, the moving water passing along the sides and edges of both rudders 22, 24. The stream-flow vectors have been indicated by the reference numeral A.

Considering first the port rudder 22, this particular rudder has been depicted at an angle of incidence X with respect to the stream-flow vector A. The relative movement of the water producing the stream-flow causes a lateral or side force to be produced which is represented by the vector B, the vector B being at right angles to the stream-flow vector A. The stream-flow also causes a drag force represented by still another vector C, which is parallel to the stream-flow vector A. The proportion between the lateral or side force vector B and the drag force vector C depends upon the angle of incidence X as illustrated in the graph set forth in FIG. 3. For example, at an angle of incidence X of say, 15°, the ratio of the side force vector B to the drag force vector C becomes 14/3.5 or 4:1.

Still referring to FIG. 2, the angle of the starboard rudder 24 is referenced to the stream-flow as with port rudder 22 except that it has been shown at a lesser angle of incidence Y, say, 2.5°. The stream-flow, which has again been indicated by the vector A, past the rudder 24 results in a different side force vector D, and a drag force vector E. FIG. 2 graphically pictures the ratio of the side force vector D to the drag force vector E, more specifically, 4.8/0.5 to 9.6:1.

The different rudder angles or attitudes illustrated in FIG. 2 represent a toe-in situation, a misalignment with respect to the parallel stream-flow denoted by the vector A in FIG. 2. The resultant side force vector F, drawn for clarity at PP, acts through the origin indicated by the letter P. The resultant vector F is the sum of the side force vector B produced by the rudder 22, and the side force vector D produced by the rudder 24. The resultant side force vector F thus acts to move the stern 12 of the boat 10 to the starboard relative to the stream-flow vector A, thereby providing a desired amount of steering control.

Referring once again to FIG. 3, the side force vector B, produced by the port rudder 22 at an angle of incidence where X equals 15°, is 14 pounds. The side force vector D of rudder 24, being at an angle of incidence where Y equals 2.5°, is 4.8 pounds. The resultant side force vector F is 14+4.8 or 18.8 pounds.

The resultant drag force vector labeled G, drawn for clarity at PP, acts through origin P of FIG. 2. The resultant vector G is the sum of the drag force vector C produced by the port rudder 22 and the drag force vector E produced by the starboard rudder 24. The resultant drag force vector G acts to slow the boat down or cause additional power to be expended in order to maintain the same stream-flow velocity as when both angles of incidence X and Y are at 0° and the drag forces are at a minimum.

Consequently, as can be seen from FIG. 3, the drag force vector C, produced by the port rudder 22 when the angle of incidence X equals 15°, is 3.5 pounds. The drag force vector E of the starboard rudder 24, when at an angle of incidence Y equal to 2.5°, is 0.5 pound. The resultant drag force vector G is 3.5+0.5 or 4 pounds.

The resultant drag force G can be minimized and still maintain the same resultant side force F if the side force vector B of the rudder 22 is made the same as the side force vector D of the rudder 24. If both vector B and vector D equal 9.4 pounds, the resultant side force vector F, will be 18.8 pounds, as before. Referring again to FIG. 3, it will be perceived that the drag force is 1.5 pounds when the side force is 9.4 pounds. Thus, the drag force vector C of the rudder 22 equals the drag force vector E of the rudder 24 and both have an angle of incidence where X and Y each equals 7°. The resultant drag force vector G equals 3 pounds which is 25% less than in the previous example where the side force vector B does not equal the side force vector D.

The different rudder angles illustrated in FIG. 4 depict a toe-out situation or a misalignment with respect to the parallel stream-flow vectors A. For example, the angle of incidence X of the port rudder 22 equals the negative angle of incidence Z of the starboard rudder 24. For an angle of incidence where X equals 15°, the rudder 22 will provide a side force vector B of 14 pounds which is directed in the starboard direction. The angle of incidence Z of the rudder 24 is −15° and thus produces a side force vector J of 14 pounds directed in the port direction. The resultant side force is 0 and there will be no turning motion imparted to the boat 10.

The drag force vector C produced by the rudder 22 equals 3.5 pounds, as before. The drag force vector K produced by the rudder 24 also equals 3.5 pounds because the angle of incidence Z is −15°. The resultant drag force H is the sum of the drag force C and the drag force K, which is 3.5+3.5 or 7 pounds.

The resultant drag force H, drawn for clarity at QQ, acts through the origin labeled Q in FIG. 4. It acts either to slow the boat 10 down or consume more power if the stream-flow velocity A is maintained.

The resultant drag force H can be minimized and still maintain a 0 side force, that is, a zero turning effect, by reducing both the side force vector B of the rudder 22 and the side force vector J of the rudder 24 to zero. Referring again to FIG. 3, it will be discerned that the drag force is 0.2 pounds when the side force is 0. Hence, the resultant drag force vector H becomes 0.4 pound which is the sum of the drag force vector C and the drag force vector K. It should be recognized that this is a 94% reduction in the overall drag force.

To achieve minimum rudder drag under all rudder angles required for controlling the boat 10, the side force vector B of the rudder 22 must always equal the side force vector D of the rudder 24 (FIG. 2) and the two side forces must never be allowed to act in opposite directions (as in FIG. 4).

It should be noted that the side force vector B and the drag force vector C (FIG. 2) act through a point R called the hydrodynamic center-of-effort of the rudder 22, which point R is located a distance spaced from the axis about which the rudder 22 pivots, this being the axis provided by the hinge 26, more specifically, the pin 30. The two vector forces B and C produce a torque which tends to rotate the rudder 22 in a counterclockwise direction. The counterclockwise rotation of the rudder 22 can only be prevented by applying a force L on the control arm 32 which creates an oppositely directed torque of equal magnitude.

Similarly, the side force vector D and the drag force vector E produce a counterclockwise torque of the rudder 24 about its pivotal axis which may be balanced by a force M on the control arm 34 which creates an oppositely directed torque of equal magnitude.

As previously described herein, when the minimum drag condition is obtained to achieve a resultant side force F of 18.8 pounds, each rudder generates a side force of 9.4 pounds and the angle of incidence of each of the two rudders 22, 24 is the same, that is, 7°. Because the rudder forces and angles are the same, their torques are the same; thus the force L equals the force M.

DESCRIPTION OF THE PREFERRED EMBODIMENTS

One embodiment of my invention is illustrated in FIG. 5. It will be perceived that the construction set forth in FIG. 5 generally resembles that of FIG. 1. However, there are important differences that contribute to providing a vastly improved steering apparatus. Thus, whereas the steering apparatus pictured in FIG. 1 has been indicated generally by the reference numeral 20, the modified steering apparatus constituting one form of my invention, as illustrated in FIG. 5, has been indicated generally by the reference numeral 120. Actually, it will facilitate a comparison of the apparatus 20 appearing in FIG. 1 to use the prefix "1" before those parts possessing a general correspondence to those appearing in FIG. 1. Hence, the steering apparatus, in order to conform with this plan, has been given the prefix "1", thereby identifying the entire steering apparatus by the numeral 120 in FIG. 5.

Continuing with this plan, the tie rod means 140 is structurally quite different from the tie rod means 40. It will be noted that the tie rod portion 142 has a straight shank or strip section **142*a* and a gear rack 142*b* integral therewith, the gear rack 142*b* having gear teeth 142*c* formed thereon. The tie rod means 140 also includes a tie rod portion 144 comprised of a straight shank or strip section 144*a* and a gear rack 144*b*, the gear rack having gear teeth 144*c*** formed thereon.

The tie rod portion 142 is pivotally connected to the forward end of the control arm 32 by means of a pivot pin 46. Instead of the pivot pin 48, however, there is a pivot pin 148 having a pinion gear 149 rotatably carried on the tiller arm 36 by means of the pin 148, the pinion gear 149 having teeth **149*a* thereon. As can readily be discerned from FIG. 5, the two gear racks 142*b* and 144*b* are in mesh with the pinion gear 149**.

To maintain the engagement of the gear racks **142*b* and 144*b* with the pinion gear 149 are a pair of springs 151, each having an ear 151*a* that enables it to be mounted or attached to the tiller arm 36 via a screw 153 and having a free end 151*b* which has a roller 155 rotatably mounted thereon, the roller 155 in each instance bearing against the sides of the gear racks 142*b* and 144*b* so as to urge or bias them toward each other and hence into engagement with the pinion gear 149**.

Having described the construction of the steering apparatus 120, a brief description of the manner in which it functions will now be given. When the tiller arm 36 is moved in an angular direction as indicated by the double headed arrow 52, the manual force being applied to the tiller arm 36 is coupled through the pivot 148 on which the pinion 149 is rotatably mounted, such action causing the pinion gear 149, which is engaged with the two gear racks **142*b* and 144*b*, to transmit the manually created steering force through the tie rod means 140, more specifically through the straight sections or shanks 142*a* and 144*a* to the control arms 32 and 34. It is important to understand that the applied forces are in an equal relationship with each other and maintain the rudders 22 and 24 at whatever specific angles are required to effect the particular turn of the boat 10 that the operator desires and which he is manually negotiating via the rudder arm 36**.

What is not readily apparent perhaps is that if any hydrodynamic force applied to the rudder 24 is different from that to which the rudder 22 is being subjected, there is an equalization of forces that is automatically produced, which is an important feature of my invention.

Recapitulating for a moment, the vector forces described in conjunction with FIGS. 2 and 4 are not as idealized as it might seem, this being so because the hydrodynamic forces resulting from the water flow past the boat hulls 14 and 16 may very well, and indeed do, vary with respect to each other and also with respect to a perfect parallel relationship that has been selected in initially discussing the content of FIGS. 2 and 4. In practice, the stream-flow vectors A are not parallel and, in addition, they are constantly changing with wave action, turbulence, turns, boat load distribution and the like. Consequently, the force differential action of the pinion gear 149 and the tie rod portions 142 and 144 will keep the side force vectors B and D of FIG. 2 always equal by automatically altering the angles of incidence X and Y. Thus, it should be apparent that if there is any tendency for the starboard rudder 24 to shift, then that tendency is transmitted via a correcting force through the tie rod means 140 to the port rudder 22.

Perhaps a specific example will be beneficial in appreciating the merits of my invention, as illustrated in FIG. 5. If the rudders 22 and 24 have been pivoted in a clockwise direction as viewed best in FIG. 2, this being by reason of the tiller arm 36 being shifted angularly in a clockwise direction about its pivot pin 38, then the boat 10 is conditioned for a turn to the port. However, and it will be of help to keep referring to FIG. 2, if the hydrodynamic forces to which the starboard rudder 24 are such as to tend to act on this particular rudder 24 in a direction to pivot it in a counterclockwise direction, even though the turning direction requires a clockwise pivoting of both rudders, then it will be appreciated that the control arm 34 applies an equalizing force to the tie rod portion 144, more specifically via the straight section **144*a* and the gear rack 144*b*. The teeth 144*c* on the gear rack 144*b*, being in mesh with the teeth 149*a* on the pinion gear 149, rotate the pinion 149 in a counterclockwise direction. Such a direction of rotation of the pinion gear 149 is instrumental in causing the gear rack 142*b* to move in a direction to the right, that is, toward the control arm 34 with the consequence that the tie rod portion 142 acts on the control arm 32 to cause the port rudder 22** to pivot in a clockwise direction.

Stated somewhat differently, the angular positions of the rudders 22 and 24, which are determined by the tiller arm 36, will cause the boat 10 to turn in the direction desired by the operator. On the other hand, owing to the fact that each rudder 22 and 24 can shift angularly irrespective of the angled position of the tiller arm 36, the forces to which the two rudders 22 and 24 are subjected are automatically equalized. The same situation occurs if the forces are more pronounced on the port rudder 22, for then, depending upon the angle to which the greater hydrodynamic forces tend to pivot the port rudder 22, will act through the control arms 32 and 34, doing so through the agency of the tie rod means 140 and the pinion gear 149 mounted on the tiller arm 36. It makes no difference as to which rudder 22 or 24 is subjected to a greater hydrodynamic side force; the corrective action is automatic and differentially balanced in either case.

Figure 6:
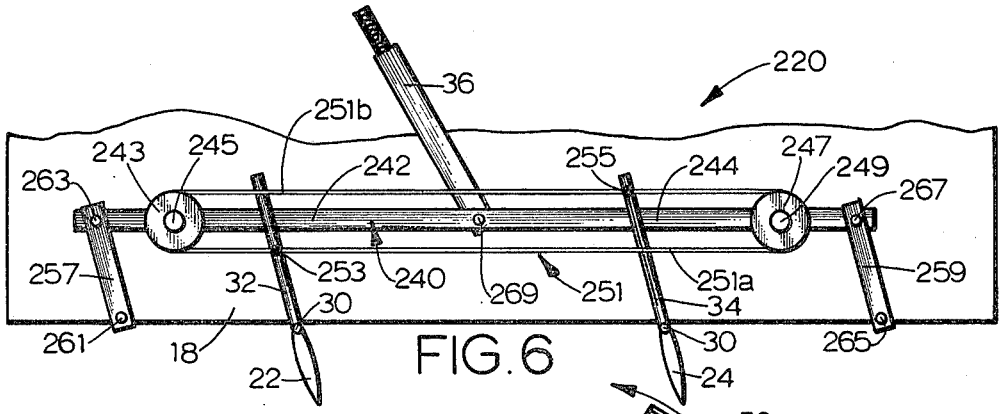
FIG. 6 is a top plan view similar to FIG. 5 illustrating a second embodiment of my invention.

The embodiment depicted in FIG. 6 has been indicated generally by the reference numeral 220. Here again, various parts are basically the same as those already referred to. Therefore, the same reference numerals have been employed to designate such common members. In the steering apparatus 220, the tie rod means 240 includes a single tie rod composed of integral portions 242 and 244. On the tie rod portion 242 is rotatably mounted a pulley 243, a pivot pin 245 carried on the tie rod portion 242 serving as a bearing for the pulley 243. Similarly, a second pulley 247 has been rotatably mounted on the portion 244, there being a pivot pin 249 that mounts this pulley for rotation. Entrained about the pulleys 243, 247 is a flexible cable or rope 251 having a first cable section **251*a* and a second flexible cable section 251*b*. The control arm 32 has its free end portion attached to the cable section 251*a* by means of a clamp 253. The other control arm 34 has its free end portion similarly attached by a cable clamp 255**.

Unlike the embodiment designated 120, this embodiment 220 includes a pair of radius arms 257 and 259. The radius arm 257 is pivoted to the deck section 18 forming the top of the hull 14 by means of a pivot pin 261, a second pivot pin 263 being employed to pivotally connect the radius arm 257 to the left end of the tie rod portion 242. The other radius arm 259 is connected to the deck section 18 above the hull 16 through a pivot pin 265, its other end being connected to the right end of the tie rod portion 244 by means of a pivot gun 267.

In order to shift the tie rod means 240 comprised of the integral portions 242, 244 laterally toward either side of the boat 10, the tiller arm 36 is pivotally connected to the tie rod portions 42 and 44 through the agency of a pivot pin 269.

The operation of the steering apparatus 220 is possibly a little more difficult to comprehend than the operation of the steering apparatus 120. Nonetheless, when a manually applied force is exerted on the tiller arm 36 so as to move the tie rod means 240 to the left, it should be understood that tension results in the cable section **251*b* as the pulley 243 moves to the left. Because the pulley 243 is free to rotate on its pivot pin 245, the tension throughout the rope section 251*b* is equal. Tension in the rope section 251*a*** would be zero.

It will be noted that since the rope section **251*b* is attached or clamped to the free end of the control arm 34, it follows that a force from the tension developed in the tie rod means 240 is applied in a direction tending to move the control arm 34 in a counterclockwise direction, thereby generating a torque which causes the rudder 24 to produce a side force. Inasmuch as the cable section 251*a* is also clamped or attached to the control arm 32 by means of the clamp 253, any tension in the rope section 251*b* is transmitted as an actuating force to the rudder arm 32 and hence to the rudder 22, tending to pivot the rudder arm 32** in a counterclockwise direction.

Because the tension developed in the rope **251*b* is the same throughout and more importantly to understand at both clamping points 253 and 255, the torques for both rudders 22 and 24 are the same, and the side force generated by the rudder 22 equals that produced by the rudder 24. Since the rope 251*a* is not under tension, it does not enter into or affect the force balances just described. Thus, irrespective of the angular position in which the tiller arm 36 is moved, the rope or cable 251*b* is free to adjust itself in accordance with whatever forces are to be transmitted from the rudder 22 to the rudder 24 (or from the rudder 24 to the rudder 22**).

While the above description has been concerned with having the tie rod means 240 moved to the left, it will be understood that if the manual force being exerted on the tiller arm 36 is such as to move the tie rod means 240 to the right, then the pulley 247 is free to rotate on its pivot pin 249, the tension in the rope 251*a* still being at every point therealong equal. There is no tension in rope 251*b* to affect control arm 32, 34 movements. The action is, of course, now just the opposite of when the tie rod means 240 is moved to the left, but nonetheless the side forces developed on the rudders 22 and 24 are equal, even though oppositely directed with respect to the previous example in which the tie rod means 240 was moved to the left.

It is important to understand that the steering apparatus 220 appearing in FIG. 6 results in the side forces on the two rudders 22 and 24 always being balanced. The angle of incidence X and Y of each rudder 22, 24, as the case may be, may differ depending upon the instantaneous stream-flow vector A at each rudder. The point to be made clear is that whenever a zero manual force is applied to the tiller arm 36, as when no change in the boat heading is desired, each control arm 32 and 34 is free to swing back and forth relatively to each other as changes in the stream-flow vector A occur due to wave action and the other factors hereinbefore mentioned. This always assures that a minimum drag condition prevails.

Now that the two embodiments represented by the reference numerals 120 and 220 have been described, it will be fairly straightforward to describe the embodiment denoted generally by the reference numeral 320. Unlike the previous embodiments 120 and 220, the steering apparatus 320 makes use of hydraulic forces in achieving equal side forces on each rudder 22 and 24.

Describing the tie rod means 340, it will be seen that the tie rod portions 342 and 344 each include a piston rod 342*a* and 344*a*, respectively, each having a piston 342*b*, 344*b* that is reciprocable within a hydraulic cylinder 342*c* and 344*c*, respectively. Whereas the tie rod portions 342 and 344 include piston rods 342*a* and 344*a*, these rods being slidable within the open end at the left of cylinder 342*c* and the open end of the cylinder 344*c*, the closed ends of these cylinders 342*c*, 344*c* each have a clevis 342*d*, 344*d* integral therewith, the clevises 342*d*, 344*d* receiving therein marginal portions of the tiller arm 36. The clevises 342*d*, 344*d* have pins 343, 345 extending therethrough and the marginal portions of the tiller arm 36 to which they are pivotally attached.

Having referred to the open and closed ends of the cylinders 342*c*, 344*d*, it will now be explained that the open end (the end slidably receiving the piston rod 342*a*) of the cylinder 342*c* has a hydraulic conduit 347, such as a flexible hose, extending therefrom to the closed end (the end having the clevis 344*d* thereon) of the other cylinder 344*c*. In this way, fluid communication is provided between the open end of the cylinder 342*b* and the closed end of the cylinder 344*b*. Similarly, a second hydraulic conduit 349 extends from the open end of the cylinder 344*c* to the closed end of the cylinder 342*c*.

Consequently, in the operation of the steering apparatus 320, when a manual actuating force is applied to the tiller arm 36, such force is immediately transferred through the pivot pins 343 and 345 to the hydraulic cylinders 342*c* and 344*c* to turn the boat 10 by reason of the force transmitted through the tie rod portions 342 and 344 and the control arms 32, 34 directly to the rudders 22 and 24. It will be recognized, though, that the hydraulic cylinders 342*c* and 344*c* apply a vector force, say 10 pounds, acting through the centerline between the pivots 343 and 345 at the closed ends of the cylinders 342*c* and 344*c*. Such movement of the tiller arm 36 to the right, as viewed in FIG. 7, results in providing a force that causes the cylinder 344*c* at the right to "compress" the hydraulic fluid trapped to the left of the piston 344*b* between the closed end of the cylinder 344*c* and the piston 344*b* contained therein.

The piston 344*b* resists movement to the right because the side force intended to pivot the starboard rudder 24 is transmitted through the tie rod portion 344 and the control arm 34 for the rudder 24. Any such movement of the cylinder 344*c* tends to be in opposition to the piston 344*b*; this results in a building up of fluid pressure within the cylinder 344*c* when multipled by the face area of the piston 344*b* constitutes the force delivered by the tie rod portion 344 to the control arm 34 and hence to the rudder 24.

However, the hydraulic fluid in the cylinder 344*c* is coupled through the conduit or hose 347 to the left or open end of the cylinder 342*c*. The pressure within the hose 347 is equal throughout and also within the volume of the hydraulic liquid residing to the left of the piston 342*b* within the cylinder 342*c*. A force is thus exerted on the piston 342*b* in a direction to cause the tie rod portion 342 to move to the right as viewed in FIG. 7. Therefore, the force generated by the transmission of hydraulic forces through the hose 347 is virtually the same as that generated in the portion of the cylinder 344*c* to the left of the piston 344*b*.

Should the fluid within the cylinder 344*c* develop a negative pressure due to the tendency of the piston 344*b* move to the left relative to the ends of the cylinder 344*c*, the fluid to the right of the piston 344*b* is coupled through the hose 347 to the right or closed end of the cylinder 342*b*and the resulting pressure, even though negative, is transmitted into the portion of the cylinder 342*b* to the right of the piston 342*b*. By the same principle of hydraulics, such negative pressure acting on the right faces of the pistons 342*b* and 344*b* produces a force component that acts in the direction that is necessary to turn the boat 10 by reason of the particular angle through which the tiller arm 36 has been manually swung. When the force vector derived from the tiller arm 36 is, say, 10 pounds, then the force developed by the two tie rod portions 342 and 344 is each equal to five pounds, and the total exerted on the control arm 34 equals the full 10 pounds.

It should be noted that the forces generated by the hydraulic action between the two positive and negative fluid pressures with respect to the pistons 342*b* and 344*b* depend only on the face areas of the pistons 342*b* and 344*b*. These forces are entirely independent of the fluid volumes to either side of the respective pistons 342*b* and 344*b*. Inasmuch as the face areas of the pistons 342*b* and 344*b* do not change, the piston rods 342*a* and 344*a* will automatically move in or out sufficiently to achieve equal forces on the tie rod portions 342 and 344.

If the tiller arm 36 is moved in an opposite sense so that the side forces in the rudders 22 and 24 are reversed, all of the force vectors would also reverse. The action of the cylinders 342*c* and 344*c* would be similar to the previous description except that negative pressure would now be positive and the positive pressure would be negative under these changed circumstances. Nonetheless, movement of the piston rods 342*a* and 344*a* would automatically position the pistons 342*b* and 344*b* so as to make the force on one tie rod portion 342 equal to the force on the other portion 344.

Figure 7:
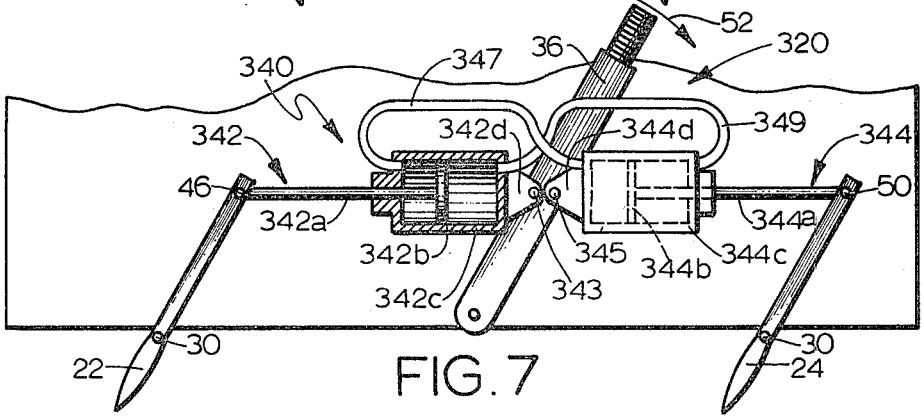
FIG. 7 is still another plan view, this view depicting still a third embodiment of my invention.

It will be appreciated that the hydraulic embodiment represented by the steering apparatus 320 shown in FIG. 7 develops forces that always balance the rudder side forces. When zero side force is desired, that is when the movement of the boat 10 is straight ahead, the control arms 32 and 34 for the rudders 22 and 24 are free to swing back and forth relative to each other as changes in the stream-flow vector A occur. This automatically results in the production of a minimum rudder drag, which is highly desirable as herein already pointed out.

I claim:

1. Steering apparatus for a sailboat comprising first and second rudders mounted for pivotal movement about laterally spaced and generally vertical axes, a first control arm rigidly connected to said first rudder and extending forwardly of the pivotal axis of the first rudder, a second control arm rigidly connected to said second rudder and extending forwardly of said second rudder, and first means pivotally connected to the forward end portion of said first control arm, second means pivotally connected to the forward end portion of said second control arm, means mounting said first and second means for movement relative to each other in a generally parallel direction for transmitting an actuating force from the first rudder, when said first rudder is pivoted in one direction about its pivotal axis via the first control arm, to the second rudder via said first and second means and the second control arm to cause said second rudder to pivot in an opposite direction from said one direction in which said first control arm is pivoted so as to substantially equalize the hydrodynamic forces on the rudders, and a pivotally mounted tiller arm, said first and second means also being movable relative to said tiller arm when moving in their said parallel direction, whereby the drag produced on said rudders is minimized.

2. Steering apparatus for a sailboat comprising first and second pivotally mounted rudders, first means for simultaneously applying substantially equal steering forces to each of said rudders to cause said rudders to pivot in the same direction for effecting a turn, and second means for transmitting corrective forces from said first rudder to said second rudder to cause said second rudder to pivot substantially an equal amount as said first rudder and relative to said first rudder so that the hydrodynamic forces acting on said second rudder are substantially equal to those acting on said first rudder, said second means including a pair of members constrained for parallel lateral movement relative to each other, whereby the drag produced by said rudders is reduced.

3. Steering apparatus in accordance with claim 2 including third means mounting said first means for manual movement, and fourth means mounting said second means for movement with said first means.

4. Steering apparatus in accordance with claim 3 in which said second means includes means for transmitting said forces from said first rudder to said second rudder via said pair of members without causing movement of said first means.

5. Steering apparatus for a sailboat comprising first and second rudders mounted for pivotal movement about laterally spaced and generally vertical axes, a control arm rigidly connected to each rudder and extending forwardly of the pivotal axis of the rudder with which it is associated, means interconnecting the forward end portions of said arms for transmitting an actuating force from the first rudder, when said first rudder is pivoted in one direction about its pivotal axis via the arm associated therewith, to the second rudder via the arm associated therewith to cause said second rudder to pivot in an opposite direction from said one direction in which the control arm associated with the first rudder is pivoted so as to substantially equalize the hydrodynamic forces on the rudders, and means for transversely shifting said interconnecting means to simultaneously transmit an actuating force to both of said arms to cause both of said rudders to pivot in said one direction in order to steer the boat, said shifting means including a tiller arm and said interconnecting means comprising tie rod means including first and second rod portions, one end of said first rod portion being pivotally connected to the forward end portion of the control arm associated with said first rudder and one end of said second rod portion being connected to the forward end portion of the control arm associated with said second rudder, said interconnecting means further including a first piston integral with the other end of said first tie rod portion, a first cylinder in which said first piston reciprocably moves, the closed end of said first cylinder being pivotally attached to said tiller arm, a second piston integral with the other end of said second tie rod portion, a second cylinder in which said second piston reciprocably moves, the closed end of said second cylinder also being pivotally attached to said tiller arm, a first conduit providing fluid conmunication between the closed end of said first cylinder and the open end of said second cylinder, and a second conduit providing fluid communication between the open end of said first cylinder and the closed end of said second cylinder, whereby the drag produced on said rudders is minimized.

6. Steering apparatus for a sailboat comprising first and second rudders mounted for pivotal movement about laterally spaced and generally vertical axes, a control arm having a rear end portion thereof rigidly connected to each rudder and extending forwardly of the pivotal axis of the rudder with which it is associated, means interconnecting the forward end portions of said arms for transmitting an actuating force from the first rudder, when said first rudder is pivoted in one direction about its pivotal axis via the arm associated therewith, to the second rudder via the arm associated therewith to cause said second rudder to pivot in an opposite direction from said one direction in which the control arm associated with the first rudder is pivoted so as to substantially equalize the hydrodynamic forces on the rudders, and means for transversely shifting said interconnecting means to simultaneously transmit an actuating force to both of said arms to cause both of said rudders to pivot in said one direction in order to steer the boat, said shifting means including a tiller arm and said interconnecting means comprising first and second rod portions, one end of said first rod portion being pivotally connected to the forward end portion of the control arm associated with said first rudder and one end of said second tie rod portion being connected to the forward end portion of the control arm associated with said second rudder, said interconnecting means further including a first gear rack integral with the other end of said first tie rod portion, a second gear rack integral with the other end of said second tie rod portion, and a pinion gear rotatably mounted on said tiller arm and engaging said first and second gear racks, whereby the drag produced on said rudders is minimized.

7. Steering apparatus in accordance with claim 6 including spring means biasing said gear racks into engagement with said pinion gear.

8. Steering apparatus for a sailboat comprising first and second rudders mounted for pivotal movement about laterally spaced and generally vertical axes, a control arm rigidly connected to each rudder and extending forwardly of the pivotal axis of the rudder with which it is associated, means interconnecting the forward end portions of said arms for transmitting an actuating force from the first rudder, when said first rudder is pivoted in one direction about its pivotal axis via the arm associated therewith, to the second rudder via the arm associated therewith to cause said second rudder to pivot in an opposite direction from said one direction in which the control arm associated with the first rudder is pivoted so as to substantially equalize the hydrodynamic forces on the rudders, and means including a tiller arm for transversely shifting said interconnecting means to simultaneously transmit an actuating force to both of said arms to cause both of said rudders to pivot in said one direction in order to steer the boat, said interconnecting means comprising tie rod means extending laterally between the forward end portions of said control arms, said interconnecting means also including first and second pulleys mounted for rotation on said tie rod means, a rope or cable entrained about said pulleys to provide first and second cable sections, the forward end portion of the control arm associated with said first rudder being attached to said first cable section and the forward end portion of the control arm associated with said second rudder being attached to said second cable section, whereby the drag produced on said rudders is minimized.

9. Steering apparatus in accordance with claim 8 including a first radius arm pivotally connected at one end to one end of said tie rod means and pivotally connected at its other end to a portion of said boat, and a second radius arm pivotally connected at one end to the other end of said tie rod means and pivotally connected at its other end to another portion of said boat.

10. Steering apparatus for a sailboat comprising a first pivotally mounted rudder, a second pivotally mounted rudder, a first control arm rigidly connected to said first rudder and extending forwardly therefrom, a second control arm rigidly connected to said second rudder and extending forwardly therefrom, a pivotally mounted tiller arm, said rudders being laterally spaced and said tiller arm being located generally between the forward ends of said control arms, a first tie member pivotally connected to said first control arm and extending transversely toward said second control arm, a second tie member pivotally connected to said second control arm and extending transversely toward said first control arm, said tie members being transversely movable relative to each other and being transversely movable relative to said tiller arm, means mounted on said tiller arm for transmitting substantially the same amount of motion from said first tie member to said second tie member and conversely from said second tie member to said first tie member to substantially equalize the hydrodynamic forces on said first and second rudders, whereby the drag produced on said rudders is minimized.

* * * * *

UNITED STATES PATENT AND TRADEMARK OFFICE

CERTIFICATE OF CORRECTION

PATENT NO. : 4,444,145

DATED : April 24, 1984

INVENTOR(S) : Douglas A. Kohl

It is certified that error appears in the above-identified patent and that said Letters Patent is hereby corrected as shown below:

Column 10, line 36, after "344b" insert -- to --.

Column 12, line 45, claim 6, after "forward" insert -- other --.

Signed and Sealed this

*Twelfth* Day of *March 1985*

[SEAL]

*Attest:*

DONALD J. QUIGG

*Attesting Officer* *Acting Commissioner of Patents and Trademarks*